US006270005B1

(12) United States Patent
Enciso

(10) Patent No.: US 6,270,005 B1
(45) Date of Patent: Aug. 7, 2001

(54) SHIPPING CARTON WITH SLOTTED FLAPS

(75) Inventor: Neil Enciso, Chicago, IL (US)

(73) Assignee: Kraft Foods Holdings, Inc., Northfield, IL (US)

( * ) Notice: Subject to any disclaimer, the term of this patent is extended or adjusted under 35 U.S.C. 154(b) by 0 days.

(21) Appl. No.: 09/651,413

(22) Filed: Aug. 30, 2000

(51) Int. Cl.[7] ..... B65D 5/50

(52) U.S. Cl. ..... 229/103.2; 206/427; 206/430; 206/784

(58) Field of Search ..... 229/103.2, 103.3; 206/429, 430, 565, 784, 427

(56) References Cited

U.S. PATENT DOCUMENTS

| | | | | |
|---|---|---|---|---|
| 2,874,869 | * | 2/1959 | Hennessey | 206/430 |
| 3,166,190 | | 1/1965 | Conrades . | |
| 3,409,124 | | 11/1968 | Jorgensen . | |
| 3,604,560 | | 9/1971 | Farquhar . | |
| 3,618,848 | * | 11/1971 | Neenah et al. | 206/784 |
| 3,828,926 | | 8/1974 | Rossi | 206/427 |
| 4,200,188 | * | 4/1980 | Webinger | 206/429 |
| 4,313,540 | * | 2/1982 | Hart et al. | 206/784 |
| 4,319,680 | | 3/1982 | Hierstra | 206/45.14 |
| 4,674,633 | * | 6/1987 | Steadman | 229/103.2 |
| 4,756,419 | | 7/1988 | Le Bras | 206/430 |
| 4,895,296 | | 1/1990 | Trauschke . | |
| 4,932,531 | | 6/1990 | Bakx | 306/499 |
| 5,197,657 | * | 3/1993 | Cassidy et al. | 229/103.2 |
| 5,429,239 | * | 7/1995 | Baxter | 229/103.2 |
| 5,966,804 | * | 12/1999 | Kuhn et al. | 206/429 |
| 6,105,774 | * | 8/2000 | Jackson | 206/430 |

* cited by examiner

*Primary Examiner*—Gary E. Elkins
(74) *Attorney, Agent, or Firm*—Fitch, Even, Tabin & Flannery

(57) ABSTRACT

A packaging assembly is provided for containers such as plastic tubs with snap-on removable lids. A carton is provided to receive multiple containers co-planar arranged to form a tier. The containers are also stacked one on top of another to form multiple tiers. The carton includes minor flaps having recesses for at least partially receiving removable lids on a lower iter, to prevent lateral shifting of one container in the tier with respect to another upon application of an inward force.

14 Claims, 3 Drawing Sheets

SHIPPING CARTON WITH SLOTTED FLAPS

BACKGROUND OF THE INVENTION

1. Field of the Invention

The present invention pertains to shipping cartons having containers with removable covers, and in particular to containers for food products.

2. Description of the Related Art

Food products and other commercially important goods have been packaged in cup or tub-like containers, as shown, for example, in U.S. Pat. Nos. 3,166,190 and 3,409,124; 4,932,531 and 3,828,926. Typically, the tub containers are of similar size and are arranged in a two dimensional array, being supported so as to lie in a common plane. In some arrangements, a paperboard sleeve or outer wrapper encircles the array of tub containers so as to hold them in position. Due to the wrapper construction, the ends of the container assemblies are usually left open, relying on the ability of the tub containers to preserve the product in its desired condition. Arrangements are also provided to make use of the tub lids or other outward protuberances to "hook" the tubs together at their upper ends, further decreasing the amount of protective overwrap. Typically, the above arrangements are provided for shipping of a single layer of tub containers.

When multiple layers or tiers of tub containers are required, an intermediate wall of paperboard material is typically disposed between the tiers. The intermediate wall may be provided in conjunction with a paperboard wrapper encircling both tiers of tub containers, as shown in U.S. Pat. Nos. 4,756,419 and 4,932,531. In one arrangement, shown in U.S. Pat. No. 4,319,680, an outer carton housing in the form of a sleeve holds multiple tiers of single row individual product units, such as display packs or blister packs having outwardly extending flanges. The carton housing receives the flanges holding them, and hence the product units, in a single stack spaced-apart relation.

Despite these developments, further improvements in food product packaging are being sought.

SUMMARY OF THE INVENTION

It is an object of the present invention to provide a shipper carton for transporting multiple containers arranged in multiple tiers with multiple containers in each tier.

Another object of the present invention is to provide a shipper carton of the type described above in which the containers have removable lids.

A further object of the present invention is to provide a shipper carton of the above-described type which provides a substantially complete enclosure for the containers.

Yet another object of the present invention is to provide a shipper container which prevents damage to the containers during handling and shipping.

These and other objects according to principles of the present invention are provided in a packaging assembly including a plurality of tub containers having removable lids;

a carton defining a hollow cavity for receiving said tub containers, including top and bottom walls;

a pair of opposed side walls extending between said top and said bottom walls;

a pair of end walls disposed between said top and said bottom walls and cooperating with said sidewalls to enclose said tub containers;

said end walls comprising minor flaps folded from said top and said bottom walls so as to face toward the carton interior and a pair of major flaps folded from said sidewalls so as to overlay said minor flaps; and said minor flaps having slots for engaging removable lids of tub containers disposed within said carton, with portions of said minor flaps being disposed underneath said lids of said tub containers so that inward force applied to said end walls is at least partially resisted by the sidewalls of said container tubs.

DETAILED DESCRIPTION OF THE PREFERRED EMBODIMENT

Figure 2:
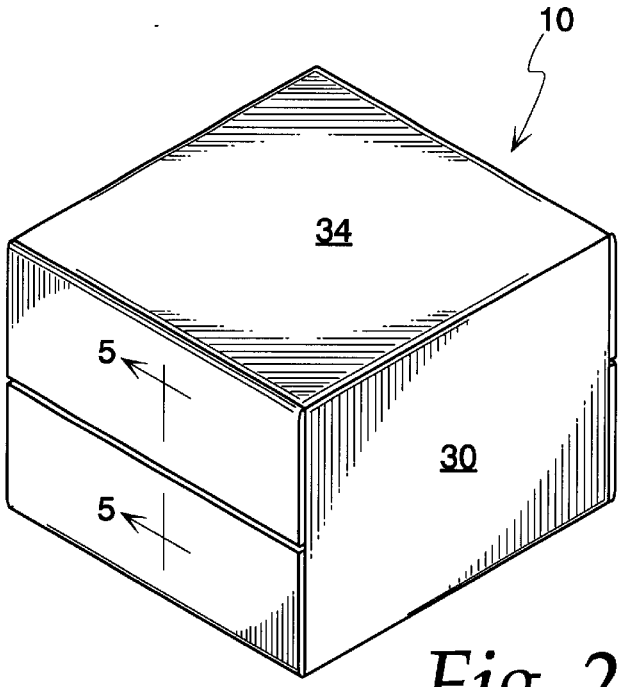
FIG. 2 is a prespective view thereof.
Figure 1:
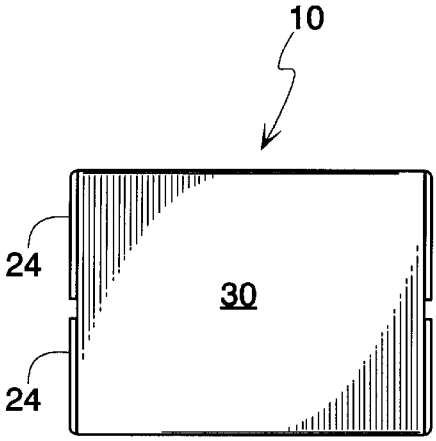
FIG. 1 is an end view of a shipping carton according to the principles of the present invention.

Referring now to the drawings, and initially to FIGS. 1–6, a shipping carton 10 is shown for transporting a plurality of tub-like containers 12 having tapered sidewalls and removable lids 14. Lids 14 are preferably snap fit to containers 12, but removable lids of other types may be used, as well. Together, the carton 10 and containers 12 comprise a shipping assembly for transporting contents such as food products disposed within the container 12. It is important in many areas of commerce, and especially for food products, that the containers 12 remain sealed until their safe destination to an end user.

As will be seen herein, the shipping carton of the present invention provides particular advantages when used to ship groups of containers stacked in two tiers, one above the other, with multiple containers arranged side-by-side in each tier. In the preferred embodiment as shown in the figures, eight containers are shipped in carton 10, with upper and lower tiers having four containers each. Preferably, the containers are disposed in close pack relationship. In the preferred method of loading carton 10, containers 12 are inserted within the carton sleeve upside-down, with their lids 14 facing downward. The carton 10 is then rotated to the upright position shown in the figures. It is preferred in carrying out the present invention, that the containers 12 be loaded into carton 10 without benefit of internal divider panels, particularly vertical divider panels separating the containers in a given tier. If desired, the carton can be loaded as a pre-formed sleeve open at both ends, or sealed at one end. The carton can also be loaded in an upright position. With closing and sealing of the carton ends to form a complete enclosure, the product is made ready for shipment to a remote location.

Figure 3:
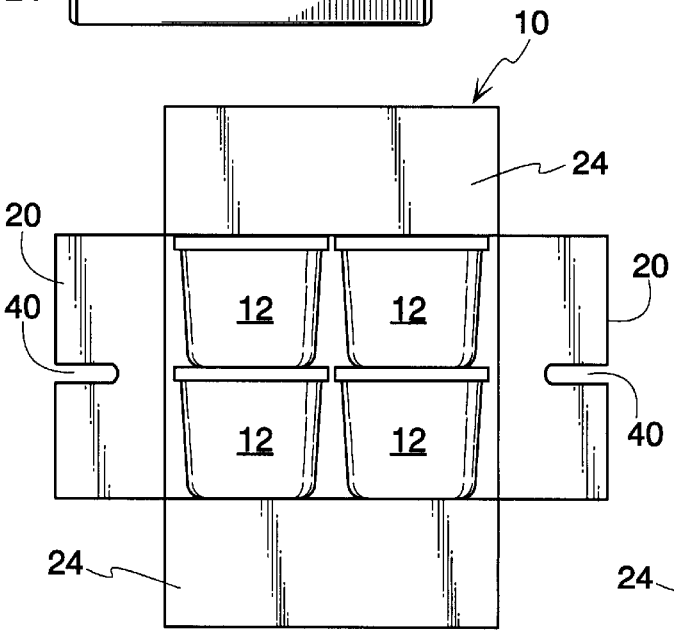
FIG. 3 is an open ended view thereof.
Figure 4:
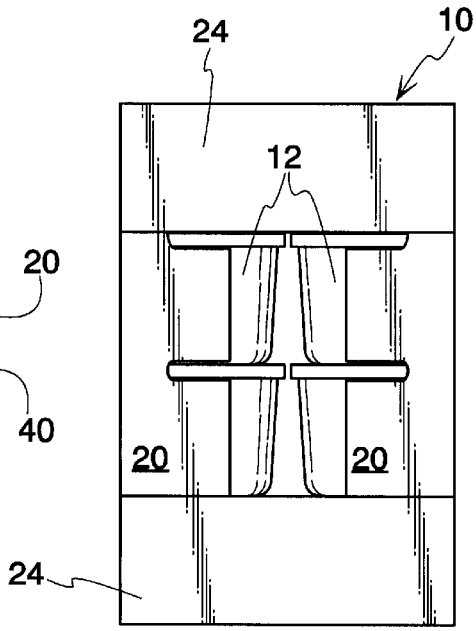
FIG. 4 is a partially closed end view thereof.

As can be seen in the end views of FIGS. 3 and 4, the containers 12 preferably have a tapered sidewall with the lids 14 comprising the widest extent of the completed container. It was discovered, in the course of developing the present invention, that, without proper constriction of movement, the containers 12 tended to "shingle" during shipping and/or handling. Removable lids of one container were occasionally observed to ride up and over the removable lid of a laterally adjacent container, in shingling relationship. Due to weight of product within the container or other jostling movement, some up-ended removable lids were separated from their respective containers. Although containers having tapered sidewalls are shown in the preferred embodiment, it will be appreciated that containers having straight sidewalls will also receive benefits from the present invention.

It is believed that inwardly directed pressures applied to the carton during transport lead to shingling displacement of the containers. As mentioned, it is desired that the dislodging forces be restrained or otherwise mitigated without resort to internal dividers located between containers 12. According to one aspect of the present invention, the desired restraint of movement of the containers 12 is provided in a double layer end closure arrangement. As can be seen in FIGS. 3 and 4, the ends of the containers 12 are closed by both minor flaps 20 and major end flaps 24. In the preferred embodiment, the minor end flaps 20 extend from sidewalls 30 of the carton, while the major end flaps 24 extend from top and bottom panels 34, 36 of the carton.

Figure 5:
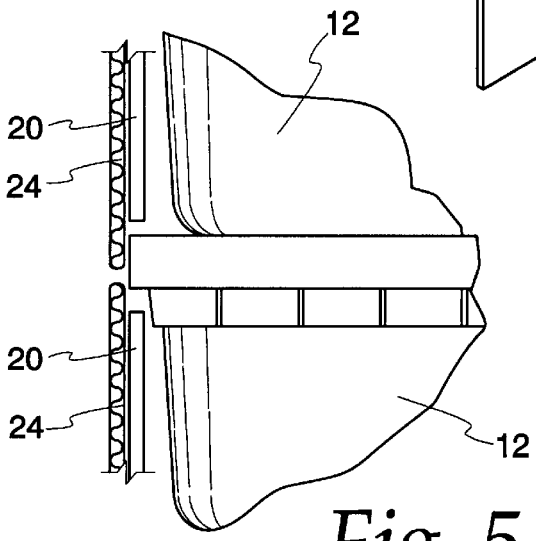
FIG. 5 is a cross-sectional view taken along the line 5—5 of FIG. 2.

As shown in FIG. 4, it is generally preferred that the minor flaps 20 when closed, have opposed spaced apart edges. Although less preferred, the minor panels 20 could be extended such that the free edges thereof would contact one another at the center of the carton. It is generally preferred that the major flaps 24 be dimensioned such that their free edges touch one another or are at least closely spaced to one another when the major flaps are closed, as can be seen, for example, in FIG. 5. While the major flaps 24 provide sufficient closure for carton 10, the minor flaps 20 are included to also provide a spacer or constraining feature, resisting the sideways displacement of containers 12. More particularly, the minor flaps 20 include notches or slotted sections 40 extending from the opposed free edges 38 of the minor flaps. With the minor flaps closed, as shown for example in FIG. 4, recesses cooperating to form a continuous opening are provided to receive removable lids of laterally adjacent containers, located adjacent the minor flaps. As can be seen in FIG. 4, for example, the notches 40 are located in registry with the lids 14 of the lower tier of containers 12. As shown in FIG. 5, the notched sections 40 allow relief for lids 14, effectively preventing shingling of the containers. Alignment of the notched sections 40 and lids 14 is preferably attained by arranging the containers in a close-packed relationship within a tight fitting, close tolerance carton, without the use of interior inserts, dividers or other separate members which tend to complicate high speed automated assembly.

Figure 8:
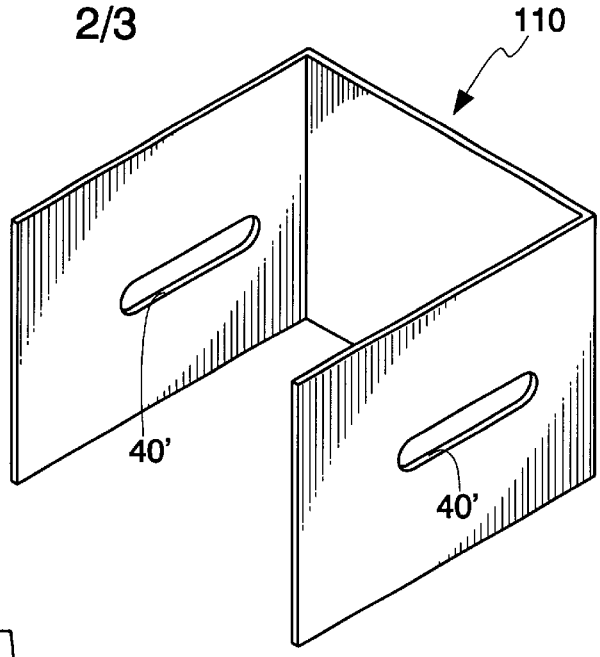
FIG. 8 is a perspective view of an optional carton insert.
Figure 7:
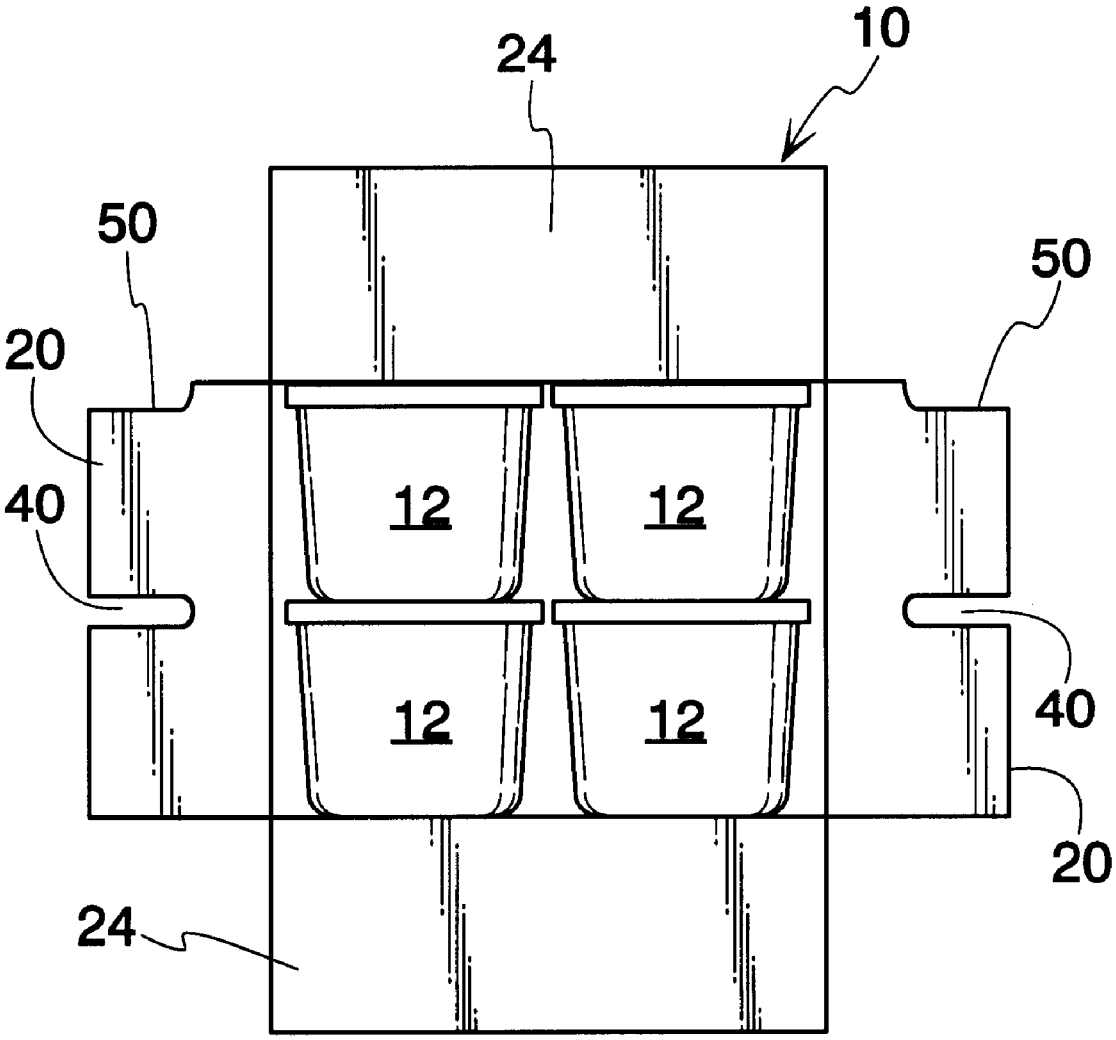
FIG. 7 is an end view showing an optional shipping carton arrangement.

It has been found necessary to provide notched section relief only for the lower tiers of containers 12. If notched section relief is also required for the upper tier of containers, additional notches 50 can be provided, as shown in FIG. 7. As a further, less preferred option, a single piece insert 110 shown in FIG. 8 with notched sections 40' can be used in conjunction with a prior art featureless carton, or in conjunction with the carton 10 described above to provide additional spacing as required. The insert 110 is readily adapted for automated assembly with an array of containers prior to insertion in a carton. For example, the containers 12 can be arranged in a three-dimensional array on a work surface, with the insert 110 wrapped about the array. The carton 10 could be constructed about the container array using automated techniques. Alternatively, the container array can be inserted into an opening of a partially completed container, with the insert 110 aiding in the sliding insertion of the array within a carton.

Figure 6:
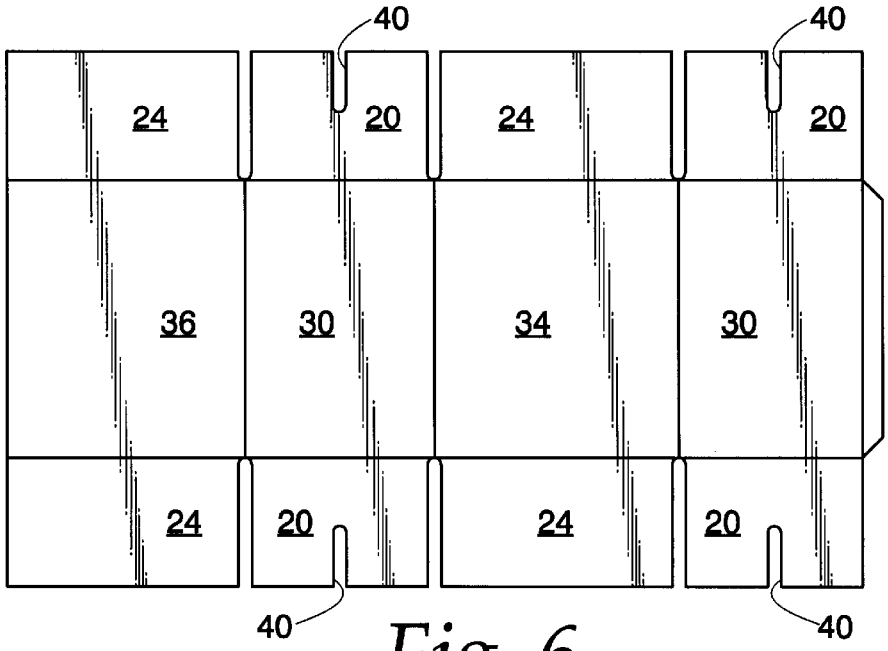
FIG. 6 is a top plan view of a blank from which the carton is formed.

It can be seen from FIG. 6 that shipping cartons according to the present invention can be fabricated from a unitary carton blank. Only simple folds are required for carton fabrication, without special punch-outs or "glue-ups".

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. A packaging assembly including:

a plurality of containers having removable lids;

a carton defining a hollow cavity for receiving said containers, including top and bottom walls, a pair of opposed side walls extending between said top and said bottom walls, and a pair of end walls disposed between said top and said bottom walls and cooperating with said sidewalls to enclose said tub containers;

said end walls comprising minor flaps folded from said top and said bottom walls so as to face toward the carton interior and a pair of major flaps folded from said sidewalls so as to face toward said minor flaps; and said minor flaps having recesses for at least partially receiving removable lids of containers disposed within said carton, so as to prevent lateral shifting of one container with respect to another upon application of inward force to said container assembly.

2. The packaging assembly of claim 1 wherein said containers are disposed in multiple tiers, with multiple containers in each tier.

3. The packaging assembly of claim 1 wherein each tier includes four containers arranged on a common plane.

4. The packaging assembly of claim 1 wherein said removable lids are disposed immediately adjacent one another without intervening wall members.

5. The packaging assembly of claim 1 wherein said containers have tapered sidewalls with lower ends of predetermined size and upper ends of enlarged size.

6. The packaging assembly of claim 1 wherein said removable lids are snap fit to the containers.

7. The packaging assembly of claim 1 wherein said minor flaps have ends which oppose one another, and said recesses extend away from said ends.

8. The packaging assembly of claim 7 wherein said recesses cooperate to form a continuous opening for receiving the removable lids of laterally adjacent containers.

9. The packaging assembly of claim 1 wherein portions of said minor flaps are disposed underneath said lids of said tub containers so that inward force applied to said end walls is at least partially resisted by the sidewalls of said container tubs.

10. An arrangement for packaging a food product, comprising:

a plurality of containers having snap-fit removable lids, said containers further having tapered sidewalls with lower ends of pre-determined size and upper ends of enlarged size;

a carton defining a hollow cavity for receiving said containers, including top and bottom walls, a pair of opposed side walls extending between said top and said bottom walls, and a pair of double layer end walls disposed between said top and said bottom walls and cooperating with said sidewalls to enclose said tub containers;

said end walls comprising minor flaps folded from said top and said bottom walls so as to face toward the carton interior and a pair of major flaps folded from said sidewalls so as to overlay said minor flaps;

said minor flaps having recesses for at least partially receiving removable lids of containers disposed within said carton, so as to prevent lateral shifting of one container with respect to another upon application of inward force to said container assembly; and said removable lids are disposed immediately adjacent one another without intervening wall members.

11. The packaging assembly of claim 10 wherein said containers are disposed in multiple tiers, with multiple containers in each tier.

12. The packaging assembly of claim 10 wherein each tier includes four containers arranged on a common plane.

13. The packaging assembly of claim 10 wherein said removable lids are snap fit to the containers.

14. The packaging assembly of claim 10 wherein said minor flaps have ends which oppose one another, and said recesses extend away from said ends, with said recesses cooperating to form a continuous opening for receiving the removable lids of laterally adjacent containers disposed adjacent the minor flaps.

* * * * *